US008311460B2

(12) United States Patent
Okimura et al.

(10) Patent No.: US 8,311,460 B2
(45) Date of Patent: Nov. 13, 2012

(54) IMAGE FORMING APPARATUS

(75) Inventors: Naomasa Okimura, Saitama (JP); Mitsugu Inomata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 677 days.

(21) Appl. No.: 12/367,790

(22) Filed: Feb. 9, 2009

(65) Prior Publication Data

US 2010/0054815 A1 Mar. 4, 2010

(30) Foreign Application Priority Data

Aug. 26, 2008 (JP) ..... P2008-216441

(51) Int. Cl.
*G03G 15/08* (2006.01)

(52) U.S. Cl. ..... 399/254; 399/119; 399/256

(58) Field of Classification Search ..... 399/254–256, 399/119

See application file for complete search history.

(56) References Cited

U.S. PATENT DOCUMENTS

| | | | | |
|---|---|---|---|---|
| 2005/0232653 | A1 | 10/2005 | Murooka | 399/92 |
| 2006/0245792 | A1 | 11/2006 | Tatsumi et al. | 399/254 |
| 2007/0231014 | A1 | 10/2007 | Noguchi et al. | 399/254 |
| 2008/0085137 | A1* | 4/2008 | Suzuki | 399/254 |

FOREIGN PATENT DOCUMENTS

| | | | |
|---|---|---|---|
| JP | 06-250521 | | 9/1994 |
| JP | 07-028294 | | 1/1995 |
| JP | 2001-42624 | A | 2/2001 |
| JP | 2001-249522 | | 9/2001 |
| JP | 2002-258560 | | 9/2002 |
| JP | 2005-77478 | A | 3/2005 |
| JP | 2005-250369 | A | 9/2005 |
| JP | 2006-308964 | A | 11/2006 |
| JP | 2007-65271 | | 3/2007 |
| JP | 2007-147893 | A | 6/2007 |
| JP | 2007-271830 | A | 10/2007 |
| JP | 2008026828 | | 2/2008 |

* cited by examiner

*Primary Examiner* — Hoang Ngo
(74) *Attorney, Agent, or Firm* — Sughrue Mion, PLLC

(57) ABSTRACT

A visible image forming device is provided with an image carrier and a developing device that develops a latent image on the image carrier surface to form a visible image includes, a developer container that contains developer therein, a developer carrier carries the developer on a surface of the developer carrier and rotates oppositely to the image carrier, a first stirring member that is rotatably supported to be adjacent to the developer carrier inside the developer container and conveys the developer to be supplied to the developer carrier while stirring the developer, and a second stirring member that is rotatably supported to be adjacent to the first stirring member inside the developer container and circulates the developer by conveying the developer in the developer container oppositely to a conveyance direction of the first stirring member.

14 Claims, 14 Drawing Sheets

G1k
LHk
1b
1a
1
12a
Gk
11
12b
G14
12
12c
G15
Z
X
Y
(-Y)
(-X)
(-Z)
Pk
TCk
21c
21b
22
22a
21a
22b
22c
12c
26a
26b
21

IMAGE FORMING APPARATUS

CROSS-REFERENCE TO RELATED APPLICATION

This application is based on and claims priority under 35 USC 119 form Japanese Patent Application No. 2008-216441 filed Aug. 26, 2008.

BACKGROUND

Technical Field

The present invention relates to a visible image forming device and an image forming apparatus.

SUMMARY

According to an aspect of invention, a visible image forming device is provided with an image carrier that carries and rotates an image on a image carrier surface, a developing device that develops a latent image on the image carrier surface to form a visible image includes, a developer container that contains developer therein, a developer carrier that is disposed opposite to the image carrier surface, and carries the developer on a surface of the developer carrier and rotates oppositely to the image carrier, a first stirring member that is rotatably supported to be adjacent to the developer carrier inside the developer container and conveys the developer in the developer container to be supplied to the developer carrier while stirring the developer, and a second stirring member that is rotatably supported to be adjacent to the first stirring member inside the developer container and circulates the developer in the developer container by conveying the developer in the developer container oppositely to a conveyance direction of the first stirring member, and a transfer device that is disposed opposite the image carrier surface, and transfers the visible image on the image carrier surface onto a transferred member in a transfer region that is opposite to the image carrier surface, wherein with respect to an imaginar, line passing through the transfer region and a rotation center of the image carrier at least a part of the second stirring member is disposed on an opposite side to a side that the developer carrier is disposed on, in a carrying region, the image is carried on the image carrier, and a first flow-in part thought which the developer conveyed by the second stirring member flows to the first stirring member is provided out of the carrying region.

According to the aspect of the present invention, in comparison with the case where the configuration of the present invention is not applied, developer may be satisfactorily conveyed to the image carrier while downsizing the configuration.

BRIEF DESCRIPTION OF THE DRAWINGS

Exemplary embodiments of the invention will be described in detail based on the following figures, wherein.

DETAILED DESCRIPTION

Figure 1:
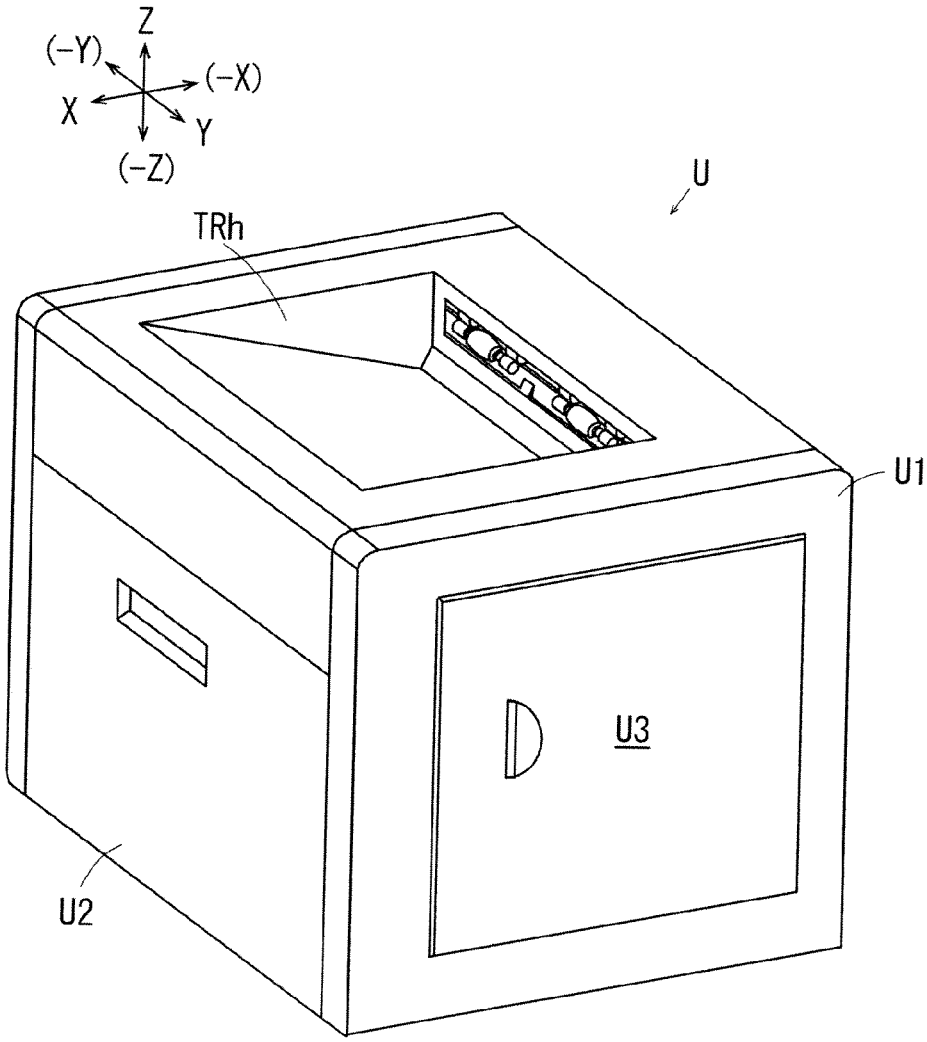
FIG. 1 is an entire perspective view of a printer of Example 1 of the present invention.

Next, detailed examples of the present invention (hereinafter, referred to as Examples) will be described, however, the present invention is not limited thereto.

For easy understanding of the following description, in the drawings, the front-rear direction is defined as an X-axis direction the right-left direction is defined as a Y-axis direction, and the up-down direction is defined as a Z-axis direction, and the directions and sides indicated by the arrows X, -X, Y, -Y, Z, and -Z are forward, rearward, leftward, upward, and downward, or the front side, the rear side, the right side, the left side, the upper side, and the lower side, respectively.

In the drawings, the middle dot described in a circle means an arrow from the back side to the surface side of the paper, and the cross mark described in a circle means an arrow from the surface side to the back side of the paper.

In the following description with reference to the drawings, illustrations of members other than members necessary for easy understanding are omitted as appropriate.

EXAMPLE 1

FIG. 1 is an entire perspective view of a printer of Example 1 of the present invention.

Figure 2:
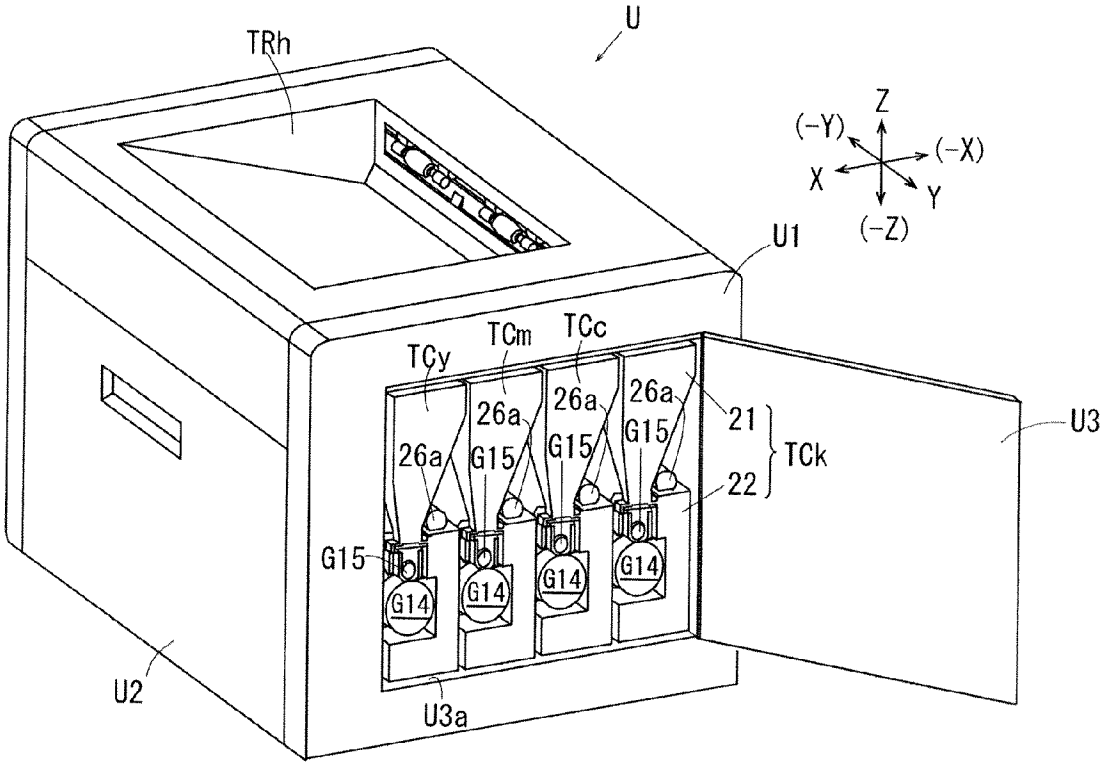
FIG. 2 is an explanatory view of the printer of Example 1 of the present invention, showing a state where a side cover is opened.

FIG. 2 is an explanatory view of the printer of Example 1 of the present invention, showing a state where a side cover is opened.

The printer U of Example 1 of the image forming apparatus of the present invention has an image forming apparatus main body U1. On the front face of the image forming apparatus main body U1, a front cover U2 as an example of a medium replenishing open and close member which is opened and closed when replenishing a new medium is supported so as to open and close around the lower end. In FIG. 1 and FIG. 2, a side cover U3 as an example of a container replacing open and close member which is opened and closed when replacing a toner cartridge as an example of a replaceable container in which new developer is replenished or a waste developer is collected, is supported so as to open and close around the rear end. On the image forming apparatus main body U1 inside the side cover U3, a cartridge attaching and removing part U3*a* as an example of a container attaching and removing part to which toner cartridges TCy to TCk as an example of a developer accommodation container described later are removably supported is formed. On an upper surface of the image forming apparatus main body U1, a sheet discharge tray TRh as an example of a sheet discharge part is provided.

Figure 3:
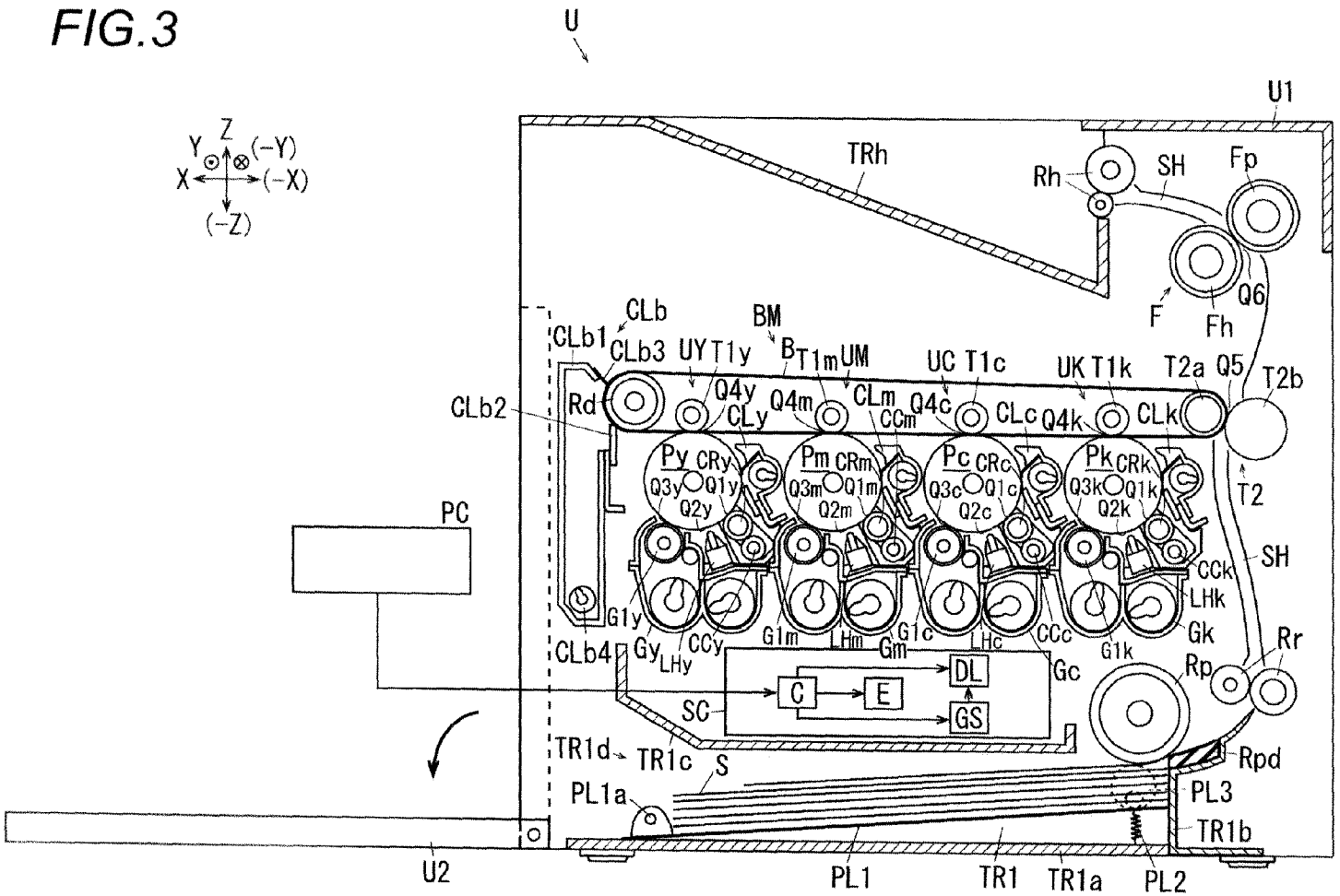
FIG. 3 is an entire explanatory view of the image forming apparatus of Example 1 of the present invention.

FIG. 3 is an entire explanatory view of the image forming apparatus of Example 1 of the present invention.

In FIG. 1 and FIG. 3, the front cover U2 is supported movably between an open position indicated by the solid line in FIG. 3 for allowing insertion of sheets as an example of a medium, and a closed position shown in FIG. 1 and FIG. 3.

In FIG. 3, in a lower portion of the printer U, a control board SC on which various control circuits and storage media, etc., are arranged is disposed. The control board SC is provided with a controller C which performs various controls of the printer U, an image processor GS the operation of which is controlled by the controller C, a latent image forming device drive circuit DL, and a power supply circuit E as an example of a power supply device, etc., are provided. The power supply circuit E applies a voltage to charge rollers CRy to CRk as an example of a charger described later, developing rollers G1*y* to G1*k* as an example of a developer carrier and transport rollers T1*y* to T1*k* as an example of a transfer device, etc.

The image processor GS converts print information input from a personal computer PC, etc., as an example of an external image information transmission device to image information for latent image formation corresponding to four-color images of yellow, magenta, cyan, and black, that is, Y, M, C, and K and outputs the image information to the latent image forming device drive circuit DL at a predetermined timing.

When a document image is a single-color image, that is, monochrome, image information of only black is input to the latent image forming device drive circuit DL.

The latent image forming device drive circuit DL has drive circuits for the colors Y, M, C, and K (not shown), and outputs signals corresponding to the input image information to LED heads LHy, LHm, LHc, and LHk as an example of a latent image forming device arranged for the respective colors at a predetermined timing.

In FIG. 3, above the control board SC, visible image forming devices UY, UM, UC, and UK which form toner images as an example of visible images in colors of yellow, magenta, cyan, and black are arranged. In FIG. 3, the visible image forming device UK for black, that is, color K has a photoconductor Pk as an example of an image carrier which rotates. Around the photoconductor Pk, a charge roll CRk as an example of a charger which charges the photoconductor surface Pk, an LED head LHk as an example of a latent image forming device which forms an electrostatic latent image on the photoconductor surface, a developing device Gk which develops the electrostatic latent image on the photoconductor surface to a visible image, and a photoconductor cleaner CLk as an example of an image carrier cleaner which removes developer remaining on the surface of the photoconductor Pk, etc., are arranged.

The visible image forming devices UY, UM, and UC for other colors are also configured in the same manner as in the case of the visible image forming device UK for black.

The surfaces of the photoconductors Py to Pk are uniformly charged by the charge rolls CRy to CRk in charge regions Q1*y*, Q1*m*, Q1*c*, and Q1*k* opposed to the charge rolls Cry to CRk and then latent images are written in latent image forming regions Q2*y*, Q2*m*, Q2*c*, and Q2*k* by the LED heads LHy to LHk. The written electrostatic latent images are developed to toner images in developing regions Q3*y*, Q3*m*, Q3*c*, and Q3*k* opposed to the developing devices Gy to Gk. The developed toner images are conveyed to primary transfer regions Q4*y*, Q4*m*, Q4*c*, and Q4*k* in contact with an intermediate transfer belt B as an example of an intermediate transfer member. To the primary transfer rolls T1*y*, T1*m*, T1*c*, and T1*k* as an example of a primary transfer device arranged on the back surface side of the intermediate transfer belt B in the primary transfer regions Q4*y*, Q4*m*, Q4*c*, and Q4*k*, a primary transfer voltage having polarity reverse to the charge polarity of the toner at a predetermined timing from the power supply circuit E controlled by the controller C is applied.

Toner images on the image carriers Py to Pk are primarily transferred onto the intermediate transfer belt B by the primary transfer rolls T1*y*, T1*m*, T1*c*, and T1*k*.

The residual and extraneous matter such as transfer remaining toners and discharge products, etc., on the surfaces of the photoconductors Py, Pm, Pc, and Pk after primary transfer are cleaned up by the photoconductor cleaners CLy, CLm, CLc, and CLk. The cleaned-up surfaces of the photoconductors Py, Pm. and Pk are recharged by the charge rollers CRy. CRm, CRc, and CRk Residual, etc., which may not be removed by the photoconductor cleaners CLy to CLk and adhere to the charge rollers Cry to CRk are cleaned up by charger cleaners CCy, CCm, CCc, and CCk as an example of a charger cleaning member disposed in contact with the charge rollers Cry to CRk.

In FIG. 2 and FIG. 3, above the photoconductors Py to Pk, a belt module BM as an example of an intermediate transfer unit is disposed. The belt module BM has an intermediate transfer belt B which is an example of a transferred member and an example of an intermediate transfer member. The intermediate transfer belt B is supported rotatably by an intermediate transfer supply system including a belt drive roll Rd as an example of a drive member, a backup roll T2*a* which is an example of a driven member and an example of a secondary transfer opposed member, and the first transfer rolls T1*y*, T1*m*, T1*c*, and T1*k* disposed opposite to the photoconductors Py to Pk.

In front of the intermediate transfer belt B, a belt cleaner CLb as an example of an intermediate transfer cleaner is disposed. The belt cleaner CLb includes a cleaner container CLb1 extending in the up-down direction, a belt cleaning blade CLb2 as an example of a cleaning member which is supported by the cleaner container CLb1 and comes in contact with the intermediate transfer belt B to remove and clean up residual remaining on the surface of the intermediate transfer belt B, a film Clb3 as an example of a leakage preventive member for preventing scattering and leakage of the residual removed by the belt cleaning blade CLb2, and a residual conveyance member CLb4 which is disposed at a lower end portion of the cleaner container CLb1 and discharges and conveys the removed residual to a collecting container (not shown). The cleaner container CLb1 of Example 1 has a lower end in the up-down direction set at the lower ends of the visible image forming devices UY to UK, that is, at positions corresponding to the lower end positions of the developing devices Gy to Gk.

A secondary transfer roll T2*b* as an example of a secondary transfer member is disposed opposite to the surface of the intermediate transfer belt B in contact with the backup roll T2*a*. The backup roll T2*a* and the secondary transfer roll Tb2 compose the secondary transfer device T2 of Example 1. The region in which the secondary transfer roll T2*b* and the intermediate transfer belt B are opposed to each other forms a secondary transfer region Q5.

A monochrome image or multicolor toner images successively transferred in a superposed manner on the intermediate transfer belt B by the primary transfer rolls T1*y*, T1*m*, T1*c*, and T1*k* in the primary transfer regions Q4*y*, Q4*m*, Q4*c*, and Q4*k* are conveyed to the secondary transfer region Q5.

The primary transfer rolls T1*y* to T1*k*, the intermediate transfer belt B, and the secondary transfer device T2, etc., compose the transfer device T1+T2+B of Example 1.

Below the control board S, a paper feeding tray TR1 as an example of a medium housing is provided. The paper feeding tray TR1 has a bottom wall TR1*a* as an example of a lower wall, a rear end wall TR1*b* extending upward from the rear end of the bottom wall TR1*a*, and an upper wall TR1*c* disposed opposite and above the bottom wall TR1*a*. At a front end portion of the paper feeding tray TR1, a replenishment port TR1*d* for replenishing new recording sheets S is formed. The front end portion of the upper wall TR1*c* is formed so as to slope upward toward the outer side, that is, the front side of the replenishment port TR1*d*. Therefore, the replenishment port TR1*d* is formed to become wider toward the front side so that the distance between the upper wall TR1*c* and the bottom wall TR1*a* widens toward the front side.

On the bottom wall TR1*a*, a moving up and down plate PL1 as an example of a medium stacking part which is supported rotatably around a rotation center PL1*a* and moves up and down the recording sheets S as an example of a medium stacked thereon, is disposed. At a rear end portion of the moving up and down plate Pl1, a moving up and down spring PL2 as an example of an urging member which urges the rear end portion of the moving up and down plate PL1 upward is disposed. The moving up and down plate PL1 moves to a lowered position at which the moving up and down plate PL1 is carried parallel to the bottom wall TR1*a* by eccentric cam-like push-down members PL3 disposed at both right and left end portions when image forming is not performed. During image forming, the push-down members PL3 rotate and the moving up and down plate Pl1 is supported movably between the lowered position and a raised position shown in FIG. 3 to which the moving up and down plate PL1 is raised by the moving up and down spring PL2.

Therefore, when the front cover U2 is opened the replenishment port TR1*d* is opened to the outside, a new bundle of recording sheets S is inserted until it butts against the rear end wall TR1*b* and stacked and housed on the moving up and down plate PL1 at the lowered position At the rear of the upper wall TR1*c*, a paper feeding roll Rp as an example of a feed member is disposed. The paper feeding roll Rp is disposed at a position against which the uppermost recording sheet S of the bundle of stacked recording sheets S is butted by a spring force of the moving up and down spring PL2 in the state where the moving up and down plate PL1 is moved to the raised position. At the upper end of the rear end wall TR1*b*, a retard pad Rpd as an example of a separating member is disposed.

The recording sheets S stacked on the paper feeding tray TR1 are fed out by the paper feeding roll Rp and separated one by one in the contact region between the retard pad Rpd and the paper feeding roll Rp, and conveyed to the medium conveyance path SH. The recording sheet S in the medium conveyance path SH is conveyed to register rolls Rr as an example of a paper feeding timing adjusting member, and the recording sheet S conveyed to the register rolls Rr is fed out to the secondary transfer region Q5 in synchronization with the time when the toner images on the intermediate transfer belt B arrive at the secondary transfer region Q5.

The intermediate transfer belt B after the toner images are transferred in the secondary transfer region Q5 is cleaned by removal of residuals such as transfer remaining toners and discharge products, and discharge products, etc., remaiming on the surface by the belt cleaner CLb.

The recording sheet S on which the toner images are transferred is conveyed to a fixing region Q6 of a fixing device F. The fixing device F includes a heating roll Rh as an example of a heating fixing member and a pressurizing roll Fp as an example of a pressurizing fixing member, and the region in which the heating roll Fh and the pressurizing roll Fp are in contact with each other by a predetermined pressure forms a fixing region Q5. Unfixed toner images on the recording sheet S surface are fixed by heat d pressure when these pass through the fixing region Q6.

The recording medium S on which images are fixed is conveyed through the medium conveyance path SH and discharged to the sheet discharge tray TRh from the discharge rollers Rh as an example of a medium discharge member.

(Description of Visible Image Forming Device)

Figure 4:
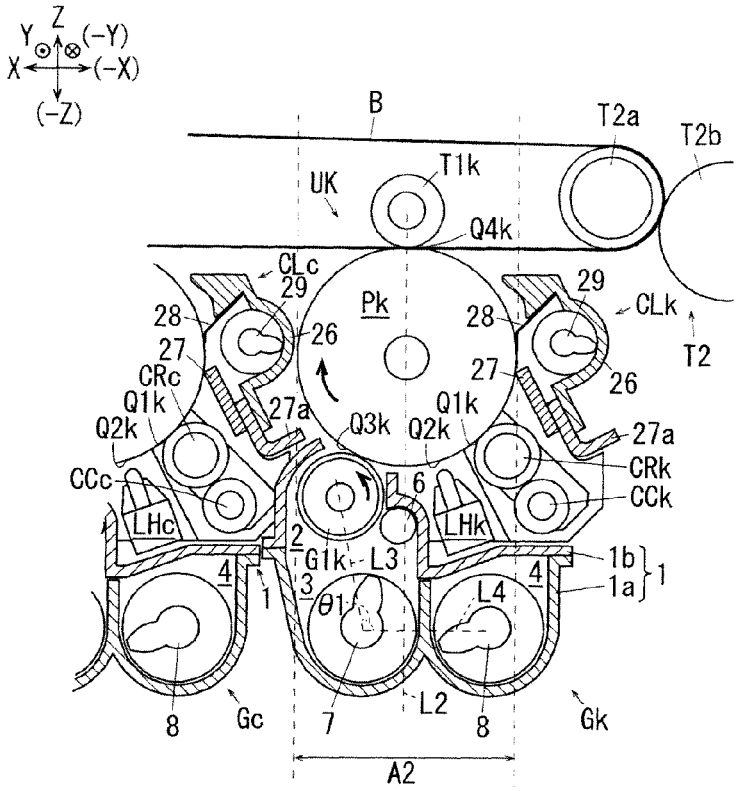
FIG. 4 is an essential portion enlarged explanatory view of a visible image forming device of Example 1 of the present invention.

FIG. 4 is an essential portion enlarged explanatory view of a visible image forming device of Example 1 of the present invention.

Figure 5:
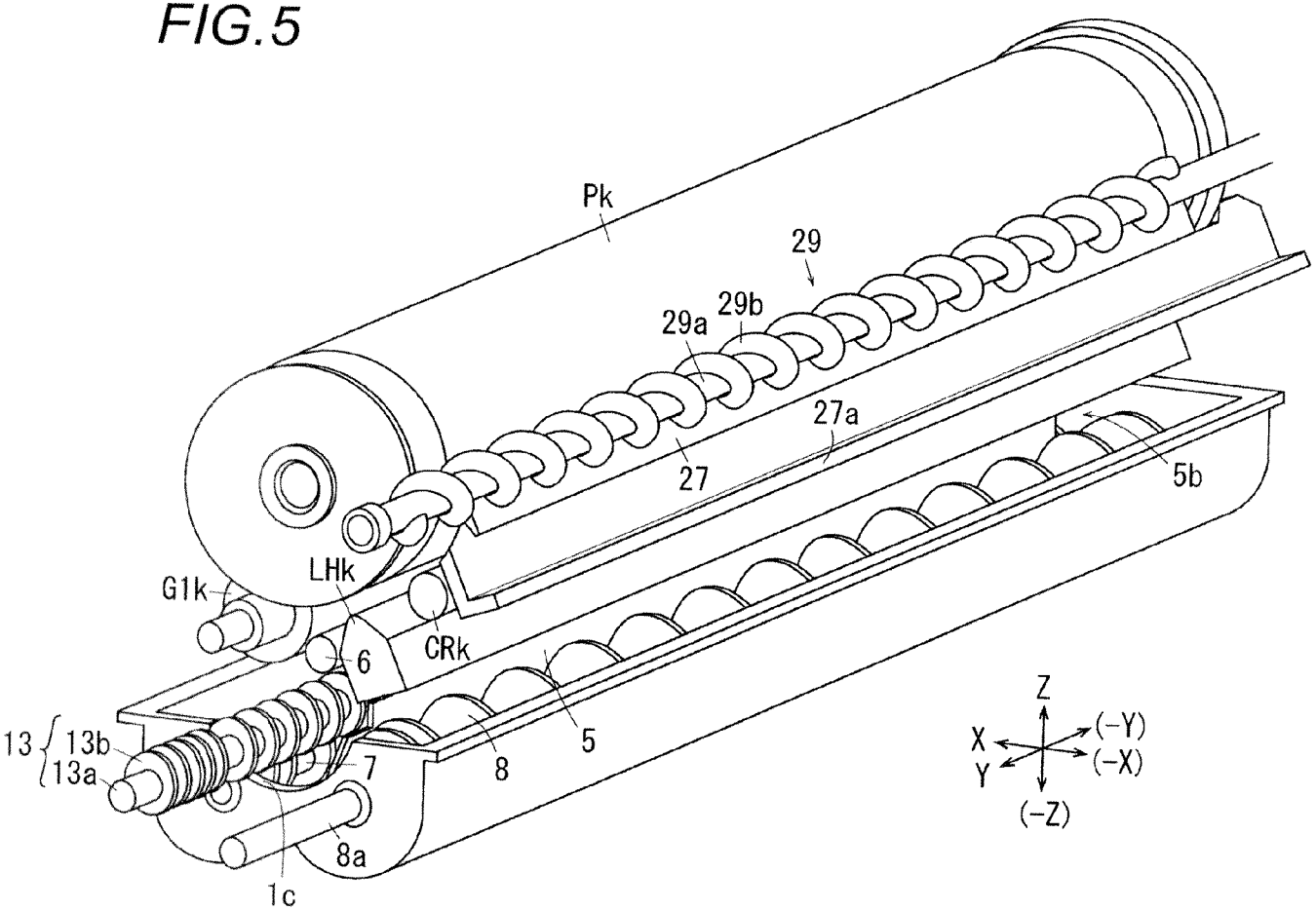
FIG. 5 is an essential portion perspective view of the visible image forming device of Example 1.

FIG. 5 is an essential portion perspective view of the visible image forming device of Example 1.

Figure 6:
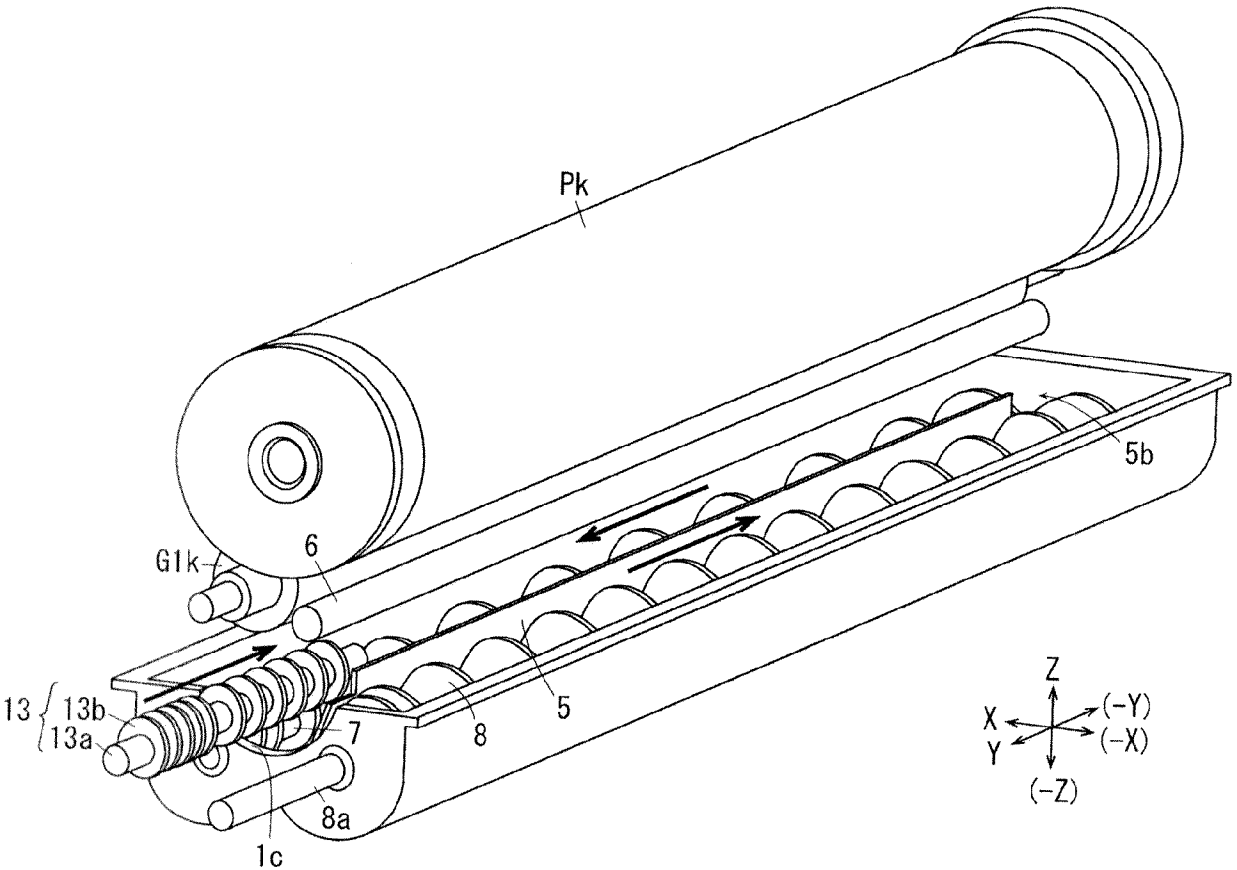
FIG. 6 is an essential portion perspective view of an image carrier and developing device of Example 1.

FIG. 6 is an essential portion perspective view of an image carrier and developing device of Example 1.

Figure 7:
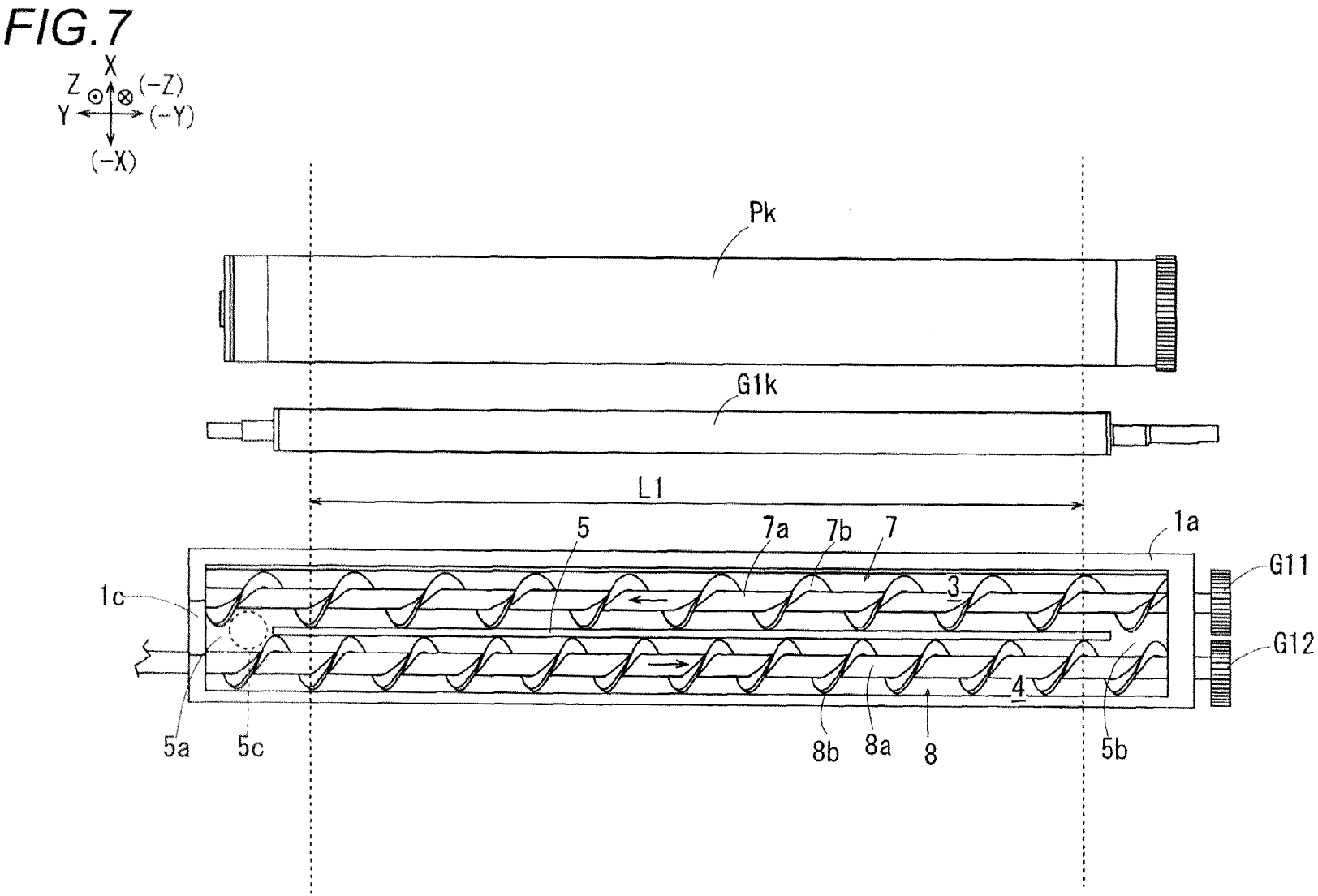
FIG. 7 is an explanatory view of the length relationship among the image carrier, a developer carrier, and a developer container.

FIG. 7 is an explanatory view of the length relationship among the image carrier, a developer carrier, and a developer container.

Hereinafter, visible image forming devices UY to UK are described in detail, however, the visible image forming devices UY to UK for the respective colors are configured similarly, so that only the visible image forming device UK for black is described, and description of other visible image forming devices UY, UM, and UC is omitted.

(Description of Developing Device)

In FIG. 4 to FIG. 7, in the visible image forming device UK of Example 1, a developing device Gk is disposed below the photoconductor Pk. In FIG. 4 to FIG. 7, the developing device Gk of Example 1 has a developer container 1 containing developer inside. The developer container 1 has a container main body 1*a* on the lower side and a lid member 1*b* covering the upper surface of the container main body 1*a*. At the right end of the container main body 1*a* replenishment path connecting part 1*c* formed of a semicircular depression is formed.

Inside the developer container 1, a developing roll chamber 2 in which the developing roller G1*k* is housed, a first stirring chamber 3 formed adjacent to and continuous to the lower side of the developing roll chamber 2, and a second stirring chamber 4 formed at the rear of and adjacent to the first stirring chamber 3 are provided.

The first stirring chamber 3 and the second stirring chamber 4 are partitioned by a partitioning wall 5 as an example of a partitioning member extending right and left, and developer in the first stirring chamber 3 or the second stirring chamber 4 may flow to the other chamber due to flow-in parts 5*a* and 5*b* formed on right and left end portions of the partitioning wall 5. In Example 1, to reduce supply of newly replenished developer in an insufficiently stirred state to the developing roller G1*k*, the device is configured so that the new developer is replenished to the replenished developer flow-in position 5*c* set in the right flow-in part 5*a*. In FIG. 7, in Example 1, the positions of the flow-in parts 5*a* and 5*b* are formed corresponding to the outside of the image forming region L1 in which image forming is performed on the photoconductor Pk as an example of a carrying region for making the image carrier carry an image to reduce harmful influence of the newly replenished developer and developer stagnating at the flow-in parts 5*a* and 5*b* on image formation.

In FIG. 4 to FIG. 7, the rotation direction of the developing roller G1*k* of Example 1 is opposite that of the photoconductor Pk, that is, in FIG. 4, the developing roller G1*k* rotates counterclockwise oppositely to the rotation direction of the photoconductor Pk which rotates clockwise. Therefore, in the developing region Q3*k*, the surface of the photoconductor Pk and the surface of the developing roller G1*k* rotate in the same direction.

In the developing roller chamber 2, at a position on the upstream side in the rotation direction of the developing roller G1*k* with respect to the developing region Q3*k*, a bar-like layer thickness restricting member 6 is supported which is disposed opposite the developing roller G1*k* and restricts the layer thickness of a developer layer carried on the surface of the developing roller G1*k*.

In the first stirring chamber 3, a supply auger 7 as an example of a first stirring member extending in the right-left direction is supported rotatably, and in the second stirring chamber 4 an admix auger 8 as an example of a second stirring member extending in the right-left direction parallel to the supply auger 7 is supported rotatably. The supply auger 7 and the admix auger 8 have rotation shafts 7*a* and 8*a* and spiral stirring blades 7*b* and 8*b* supported on the outer peripheries of the rotation shafts, respectively.

At the left ends of the rotation shafts 7*a* and 8*a*, gears G11 and G12 as an example of gears engaging with each other are supported. When driving from a developing drive source (not shown) is transmitted to the gears G1 and G2, the augers 7 and 8 are driven to rotate and convey developer in mutually opposite to directions as shown by arrows in FIG. 7. Therefore, according to the rotations of the augers 7 and 8, the developer conveyed to the downstream end of either stirring chamber 3 or 4 while being stirred flows to the upstream end of the other stirring chamber 4 or 3 through the flow-in parts 5*a* and 5*b* and is conveyed. Therefore, the developer inside the developer container I circulates inside the circulation chambers 3+4, and the developer in the first stirring chamber 3 is supplied to the developing roller G1*k* and used for development.

Figures 8A, 8B, 8C:
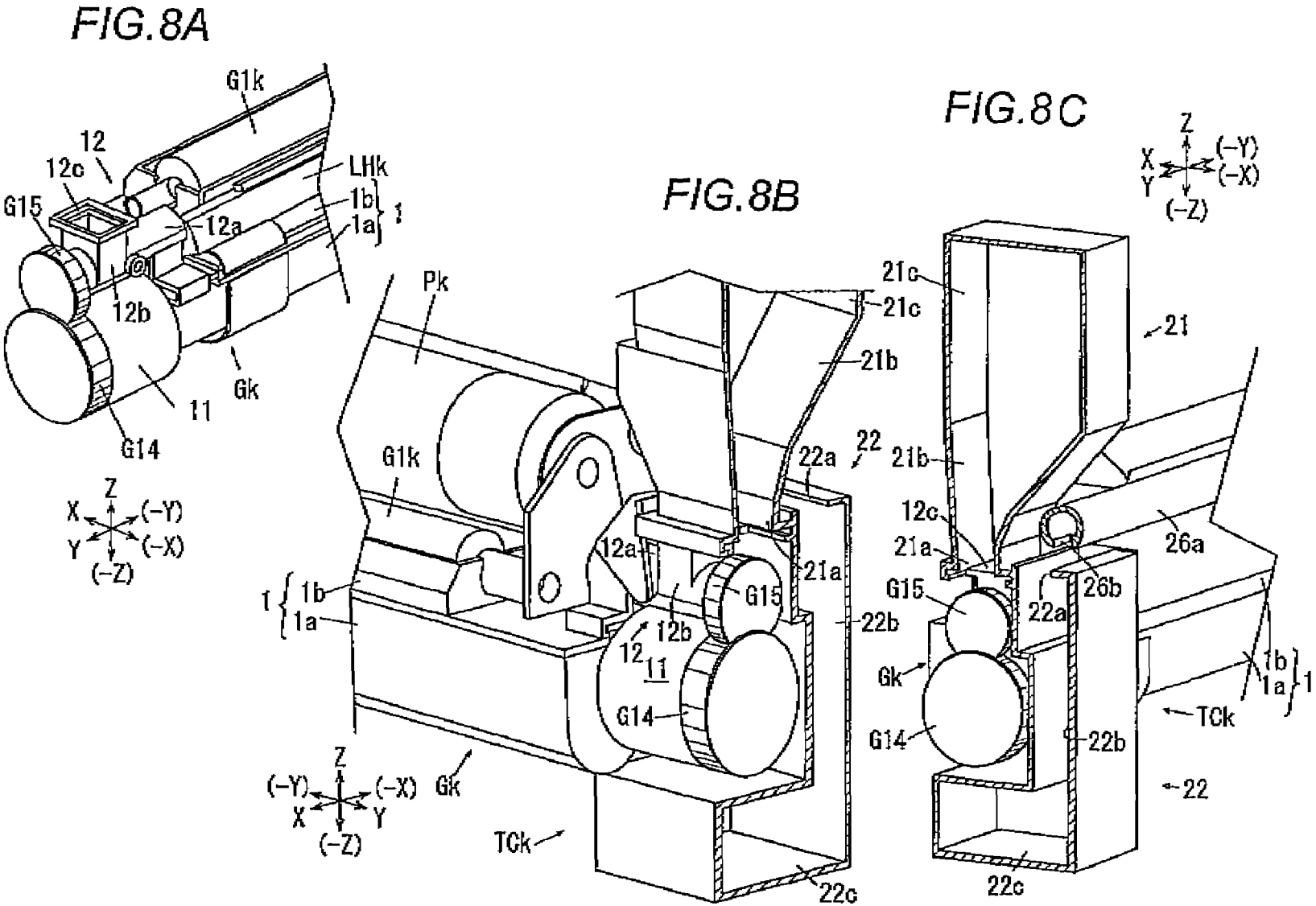
FIG. 8A is an explanatory view of a replenishment port portion of the visible image forming device of Example 1.
FIG. 8B is an essential portion sectional perspective view describing the position relationship between the visible image forming device and the replaceable container of Example 1.
FIG. 8C is an explanatory view describing the relationship between the remaining developer conveyance path and the replaceable container of Example 1.

FIGS. 8 are explanatory views of the visible image forming device and the replaceable container of Example 1, and FIG. 8A is an explanatory view of a replenishment port portion of the visible image forming device, FIG. 8B is an essential portion sectional perspective view describing the position relationship between the visible image forming device and the replaceable container, and FIG. 8C is an explanatory view describing the relationship between the remaining developer conveyance path and the replaceable container. In FIG. 2 and FIGS. 8, at a front end portion of the rotation shaft 8*a* of the admix auger 8, a clutch 11 as an example of a drive transmission switching device is supported, and at a front end portion of the clutch 11, a replenishing drive gear G14 as an example of a replenishing drive transmission gear is provided.

In FIG. 2 and FIG. 5 to FIGS. 8, at the right end portion of the developer container 1, a replenishment path forming member 12 is supported. The replenishment path forming member 12 extends leftward from the cartridge attaching and removing part U3*a* toward the developing device Gk inside, and has a replenishment cylinder 12*a* having a replenished developer conveyance path formed inside in which new developer to be replenished to the developing device Gk is conveyed. At a right end portion of the replenishment cylinder 12*a*, a flow-in port part 12*b* extending upward is formed, and at an upper end portion of the flow-in port part 12*b*, a replenished developer flow-in port I 2*c* is formed. The replenishment path inside the replenishment cylinder 12*a* extends to the upper side of a right flow-in part 5*a*, and new developer is dropped and replenished to a replenished developer flow-in position 5*c*.

In FIG. 5 and FIG. 6, to the replenishment cylinder 12*a* a replenishment auger 13 as an example of a replenished developer conveyance member extending in the right-left direction is supported rotatably. The replenishment auger 13 has a rotation shaft 13*a* and a stirring blade 13*b* formed on the outer periphery of the rotation shaft similar to the augers 7 and 8. In FIG. 2 and FIGS. 8, at the right end of the rotation shaft 13*a* of the stirring blade 13, a replenishing driven gear G15 which engages with the replenishing drive gear G14 is supported. Therefore, by switching connection and disconnection of the clutch 11, the rotation of the admix auger 8 which drives during an image forming operation is switched to be transmitted or not transmitted to the replenishment auger 13 via the replenishment gears G14 and G15, and the replenishment auger 13 rotates or stops rotating. Accordingly, the replenishment amount and timing of the developer by the replenishment auger 13 are controlled.

(Description of Photoconductor Cleaner)

In FIG. 4 to FIG. 7, in the visible image forming device UK of Example 1, the photoconductor cleaner CLk is disposed on the right of the photoconductor Pk. The photoconductor cleaner CLk of Example 1 includes a cleaner container 26 as an example of a cleaner container main body, a cleaning blade 27 as an example of a cleaning member having a base end portion supported on the cleaner container 26 via a blade support member 27*a* and a tip end portion disposed in contact with the photoconductor Pk, and a leakage preventive film 28 as an example of a leakage preventive member which comes in contact with the photoconductor Pk on the upstream side in the rotation direction of the photoconductor Pk of the cleaning blade 27 and prevents leakage of the developer.

In FIG. 8C, to the cleaner container 26, a remaining developer conveyance path 26*a* extending from the photoconductor cleaner CLk inside the cleaner container to the cartridge attaching and removing part U3*a* outside is joined, and at a right end portion that is a downstream end portion of the remaining developer conveyance path 26*a*, a remaining developer flow-out port 26*b* from which the remaining developer conveyed through the remaining developer conveyance path 26*a* flows out is formed. The remaining developer conveyance path 26*a* of Example 1 is disposed at a position displaced diagonally upward from the replenished developer conveyance path parallel to and adjacent to each other.

In FIG. 4 and FIG. 5, inside the cleaner container 26 and the remaining developer conveyance path 26*a*, a disposal auger 29 as an example of a developer disposal member which conveys the developer collected by the cleaning blade 27 toward the remaining developer flow-out port 26*b* is supported rotatably. The disposal auger 29 has a rotation shaft 29*a* and a spiral stirring blade 29*b* supported on the outer periphery of the rotation shaft 29*a* similar to the augers 7, 8, and 13.

(Description of Toner Cartridge)

In FIG. 2 and FIGS. 8, on the right of the developing devices Gy to Gk, toner cartridges TCy, TCm, TCc, and TCk are supported attachably to and removably from the toner cartridge attaching and removing part U3*a* by movements in the right-left direction in a state where the side cover U3 is opened. The toner cartridge TCk has a replenished developer accommodation part 21*a* at the upper side and a remaining developer collecting part 22 as an example of a remaining developer accommodating part at the lower portion.

The replenished developer accommodation part 21 includes a replenished developer flow-out port 21*a* which is formed at the lower end portion and connected to the replenished developer flow-in port 12*c* at the upstream end of the replenished developer conveyance path, a first accommodation part 21*b* extending upward from the replenished developer flow-out port 21*a*, and a second accommodation part 21*c* connected to the upper side of the first accommodation part 21*b*. The first accommodation part 21*b* is formed so as to widen upward in width in the front-rear direction, and the second accommodation part 21*c* is formed to a rectangular parallelepiped shape extending upward from the upper end of the first accommodation part 21*b*. The accommodation part 21*b*+21*c* including the second accommodation part 21*c* and the first accommodation part 21*b* accommodates new developer to be replenished to the developing device Gk, and developer drops and flows to the replenished developer flow-in port 12*c* from the replenished developer flow-out port 21*a* so as to make up for the developer conveyed to the downstream side according to driving of the replenishment auger 13, and accordingly, the developer is replenished.

The remaining developer collecting part 22 includes a remaining developer flow-in port 22*a* which is formed at the upper end portion and connected to the remaining developer flow-out port 26*b* at the downstream end of the remaining developer conveyance path 26*a*, a second collecting part 22*b* extending downward from the remaining developer flow-in port 22*a*, and a first collecting part 22*c* which is connected to the lower side of the second collecting part 22*b* and extends downward and forward from the lower end of the second collecting part 22*b*. Therefore, the remaining developer collecting part 22 of Example 1 is formed to an inverted L shape surrounding the replenishment gears G14 and G15 as a whole. In the remaining developer collecting part 22, remaining developer conveyed through the remaining developer conveyance path 26*a* drops and flows to the remaining developer flow-in port 22*a* from the remaining developer flow-out port 26*b*, and drops through the second collecting part 22*b* and is collected in the first collecting part 22*c*.

In the toner cartridges TCy to TCk of Example 1, as shown in FIG. 8C, the second accommodation part 21*c* is disposed at a position overlapping the replenished developer flow-out port 21*a* and the remaining developer flow-in port 22*a* as observed from above, and the first collecting part 22*c* is disposed at a position overlapping the replenished developer flow-out port 21*a* and the remaining developer flow-in port 22*a* as observed from below so that the width in the front-rear direction of each of the toner cartridges TCy to TCk including the accommodation part 21*b*+21*c* and the collecting part 22*c*+22*b* is minimized, and furthermore, the entire width of the arrangement of the toner cartridges TCy to TCk is also minimized.

On the replenished developer flow-in port 12*c*, the replenished developer flow-out port 21 a, the remaining developer flow-in port 22*a*, and the remaining developer flow-out port 26*b*, shutters as an example of an open and close member (not shown) are disposed, and are opened and closed in conjunction with attachment and removal of the toner cartridge TCy.

(Description about Disposition of Members of Visible Image Forming Device)

In FIG. 4, in the visible image forming device UK of Example 1, the admix auger 8 of the developing device Gk is disposed on the opposite side of the disposition side of the developing roller G1*k* with respect to the imaginary line L2 connecting the primary transfer region Q4*k* and the rotation center of the photoconductor Pk. Therefore, in the developing device Gk of Example 1, within the projection plate A2 of the photoconductor Pk in the case where light is imaginarily irradiated from the primary transfer region Q4*k* side most members, in particular, the supply auger 7 and the admix auger 8 are disposed.

In FIG. 4, in the developing device Gk of Example 1, the angle θ1 between the first center-to-center imaginary line L3 connecting the rotation center of the developing roller G1*k* and the rotation center of the supply auger 7 and the second center-to-center imaginary line L4 connecting the rotation center of the supply auger 7 and the rotation center of the admix auger 8 is set to be obtuse.

Furthermore, in the visible image forming device UK of Example 1, the LED head LHk is disposed above the second stirring chamber 4 of the developer container 1, and the LED head LHk is disposed between the photoconductor Pk and the admix auger 8.

The charge roller CRk and the charger cleaner CCk are disposed above the developer container 1, and are disposed at a further inner side than the rear end of the developer container 1.

Therefore, in the visible image forming device UK of Example 1, the primary transport roller T1*k* is disposed above the photoconductor Pk, and the photoconductor cleaner CLk is disposed at the rear of the photoconductor, and below the photoconductor, the developing device GK, the LED head LHk, and the charge roller CRk are collectively disposed, and in front of the photoconductor Pk, no member for black is disposed.

In the image forming apparatus U of Example 1, the paper feeding roll Rp is disposed below the visible image forming device UK for black on the extremely downstream side in the rotation direction of the intermediate transfer belt B, and is disposed within the projection plane of the visible image forming device UK.

In Example 1, the visible image forming devices UY to UK are configured in a non-replaceable manner, and have a function as a reinforcement member which joins right and left frames of the image forming apparatus main body U1, that is, a function as a strength member (reinforcement frame).

Operation of Example 1

In the printer U as an example of the image forming apparatus of Example 1 including the above-described constituents, in the visible image forming devices UY to UK, the admix augers 8 of the developing devices Gy to Gk are disposed on the opposite sides of the developing rollers G1*y* to G1*k* with respect to the imaginary lines L2 in comparison with conventional configurations. Therefore, if the admix augers 8 are disposed on the same sides of the developing rollers G1*y* to G1*k* as in the conventional configurations, that is, disposed not on the rear sides but on the front sides apart from the photoconductors Py to Pk, the lengths in the front-rear direction of the visible image forming devices UY to UK and the length in the front-rear direction of the entire printer U become long, however, in comparison with this configuration, in Example 1, the lengths in the front-rear direction of the visible image forming devices UY to UK are shorter.

Particularly, most of the developing devices Gy to Gk are disposed within the projection planes A2 of the photoconductors Py to Pk from the primary transfer devices T1*y* to T1*k* sides, and no members are disposed in front of the photoconductors Py to Pk. In other words, in the state where the four photoconductors Py to Pk are arranged horizontally, only the photoconductor cleaners CLy to CLk are present between the photoconductors Py to Pk, and no developing device Gy to Gk is present therebetween. Therefore, in comparison with the conventional configurations in which developing devices are present between the plurality of photoconductors Py to Pk, the printer U of Example 1 has a shorter length in the front-rear direction, and may be downsized.

In the printer U of Example 1, the admix augers 8 of the developing devices Gy to Gk are disposed to surround the photoconductors Py to Pk, and the positions of replenishment of the developer to the developing devices Gy to Gk and the positions of discharge of the developer from the photoconductor cleaners CLy to CLk are set close to each other. In many conventional general configurations, the admix augers 8 are disposed far from the photoconductors Py to Pk, and to reduce replenishment of new developer in an insufficiently stirred state from the supply augers 7 to the developing rollers G1*y* to G1*k* the new developer is replenished to the admix auger 8 sides. Therefore, in many cases, the replenishment path forming member 12 and the remaining developer conveyance path 26*a* for the same color are disposed apart from each other across the photoconductors Py to Pk, and easily interfere with the positions of the remaining developer conveyance path 26*a* for the adjacent color. On the other hand, in the visible image forming device of Example 1, the replenishment path forming member 12 and the remaining developer conveyance path 26*a* for the same color may be disposed in proximity to and parallel to each other, so that the device is easily designed, and the replenished developer accommodation parts 21 and the remaining developer collecting parts 22 are easily configured integrally with the toner cartridges Tcy to TCk.

In the printer U of Example 1, the rotation directions of the developing rollers G1*y* to G1*k* are set opposite to the rotation directions of the photoconductors Py to Pk, and the layer thickness restricting members 6 are disposed on the LED heads LHy to LHk sides. In other words, the layer thickness restricting members 6 may be disposed at positions closer to the imaginary lines L2, that is, positions closer to the opposite sides of the primary transfer regions Q4*y* to Q4*k* across the photoconductors Py to Pk. Therefore, the printer may be made smaller than in the case where the rotation directions of the photoconductors Py to Pk and the developing rollers G1*y* to G1*k* are the same and the layer thickness restricting members 6 are disposed apart from the LED heads LHy to LHk, that is, disposed on the sides apart from the imaginary lines L2.

Furthermore, in the printer U of Example 1, the flow-in parts 5*a* and 5*b* are formed outside the image forming regions L1. Therefore, if the right flow-in parts 5*b* are set within the image forming regions L1, the direction in which the developer flows in through the flow-in parts 5*b* and the movement direction of the surfaces of the developing rollers G1*y* to C1*k* become opposite each other, and the conveyance of the developer may stagnate, however, in Example 1, the right flow-in parts 5*b* are set outside the image forming regions L1, and the risk that the developer carried on the developing rollers G1*y* to G1*k* and the developer which flows to the flow-in parts 5*a* and 5*b* are in opposite directions and hinder each other's flow is reduced, so that the developer may be satisfactorily conveyed to the photoconductors Py to Pk.

In Example 1 the movement direction of the developer from the supply augers 7 to the developing rollers G1*y* to G1*k* and the layer thickness restricting members 6 and the flow-in direction of the developer from the supply augers 7 to the admix augers 8 in the left flow-in parts 5*a* include rearward components. Therefore, if the flow-in parts 5*a* are set inside the image forming regions L1, in the flow-in parts 5*a*, a part of the developer to be supplied from the supply augers 7 to the developing rollers G1*y* to G1*k* flows to the admix auger 8 sides, and the amount of developer at the left end portions of the developing rollers G1*y* to G1*k* is reduced, and the densities of the images to be formed may lower. On the other hand, in Example 1, the left flow-in parts 5*a* are set outside the image forming regions L1, so that the risk that sufficient developer may not be carried on the developing rollers G1*y* to G1*k* and the developer flows to the admix auger 8 sides is eliminated, and therefore, reduction in amount of developer to be carried on the developing rollers G1*y* to G1*k* and reduction in the densities of images to be formed are reduced.

In Example 1, the replenished developer flow-in positions 5*c* are set at the right flow-in parts 5*a* outside the image forming regions 11, and new developer which has flowed in from the replenished developer flow-in positions 5*c* is sufficiently stirred by the admix augers 8 and then supplied to the photoconductor Py to Pk. In other words, for example, in comparison with the case where the new developer which has flowed in the left flow-in parts 5*b* is supplied to the developing rollers G1*y* to G1*k* before being sufficiently stirred, the developer is sufficiently stirred and satisfactorily supplied and conveyed.

In the toner cartridges TCy to TCk of Example 1, the position of the replenished developer flow-out port 21 a and the position of the remaining developer flow-in port 22*a* are set at substantially the same position in the horizontal direction without overlapping in the up-down direction, and the capacities of the replenished developer accommodation part 21 on the upper side and the remaining developer collecting part 22 on the lower side may be made sufficiently large. In other words, while the toner cartridges TCy to TCk are downsized, sufficient capacities may be secured as the amount of replenished developer and the collected amount of collected developer. Regarding the positions of the replenished developer flow-out ports 21*a* and the positions of the remaining developer flow-in ports 22*a*, it is allowed that the positions of the replenished developer flow-out ports 21 a are set slightly low and the positions of the remaining developer flow-in ports 22*a* are set slightly high in the horizontal direction. In this case, it is allowed that, relative to the shape whose width in the front-rear direction widens upward of the first accommodation part 21*b*, the second collecting part 22*b* is shaped so that its width in the front-rear direction widens downward from the position of the remaining developer flow-in port 22*a*, whereby both capacity securing and downsizing are realized.

The position of the replenished developer flow-out port 21*a* and the position of the remaining developer flow-in port 22*a* are disposed so as not to overlap in the up-down direction, and the developer which has flowed to the remaining developer flow-in port 22*a* may be dropped without using a conveyance member and conveyed to the depth of the remaining developer collecting part 22, and accordingly, increases in number of parts and cost are reduced.

Furthermore, in Example 1, corresponding to the shorter lengths of the visible image forming devices UY to UK, the front end of the upper wall TR1*c* of the paper feeding tray TR1 may be sloped upward, so that the inlet of the replenishment port TR1*d* may be widened. In conventional general configurations, if the length in the front-rear direction of the printer U is increased, the length of insertion of the recording sheets S until these butt against the rear wall TR1*b* increases, and it becomes difficult to insert the recording sheets S. Therefore, it is preferable that the inlet of the replenishment port TR1*d* is widened, however, in order to widen the replenishment port TR1*d*, the height of the printer U must be increased. In Example 1, the lengths in the front-rear direction of the visible image forming devices UY to UK are shortened, and in front of the visible image forming devices UY to UK, that is, below the belt cleaner CLb and in front of the control board SC, a sufficient space is secured, so that the inlet of the replenishment port TR1*d* may be widened without increasing the height of the printer U. Therefore, through the wide replenishment port TR1*d*, recording sheets S may be replenished or taken out.

In Example 1, at the rear of the control board SC, the paper feeding roller Rp is disposed in a space secured below the visible image forming device UK on the extremely downstream side, and in comparison with the case where the paper feeding roller Rp is disposed at a position displaced reward from the visible image forming device UK, the length in the front-rear direction of the printer U may be shortened, and the printer may be downsized.

EXAMPLE 2

Figure 9:
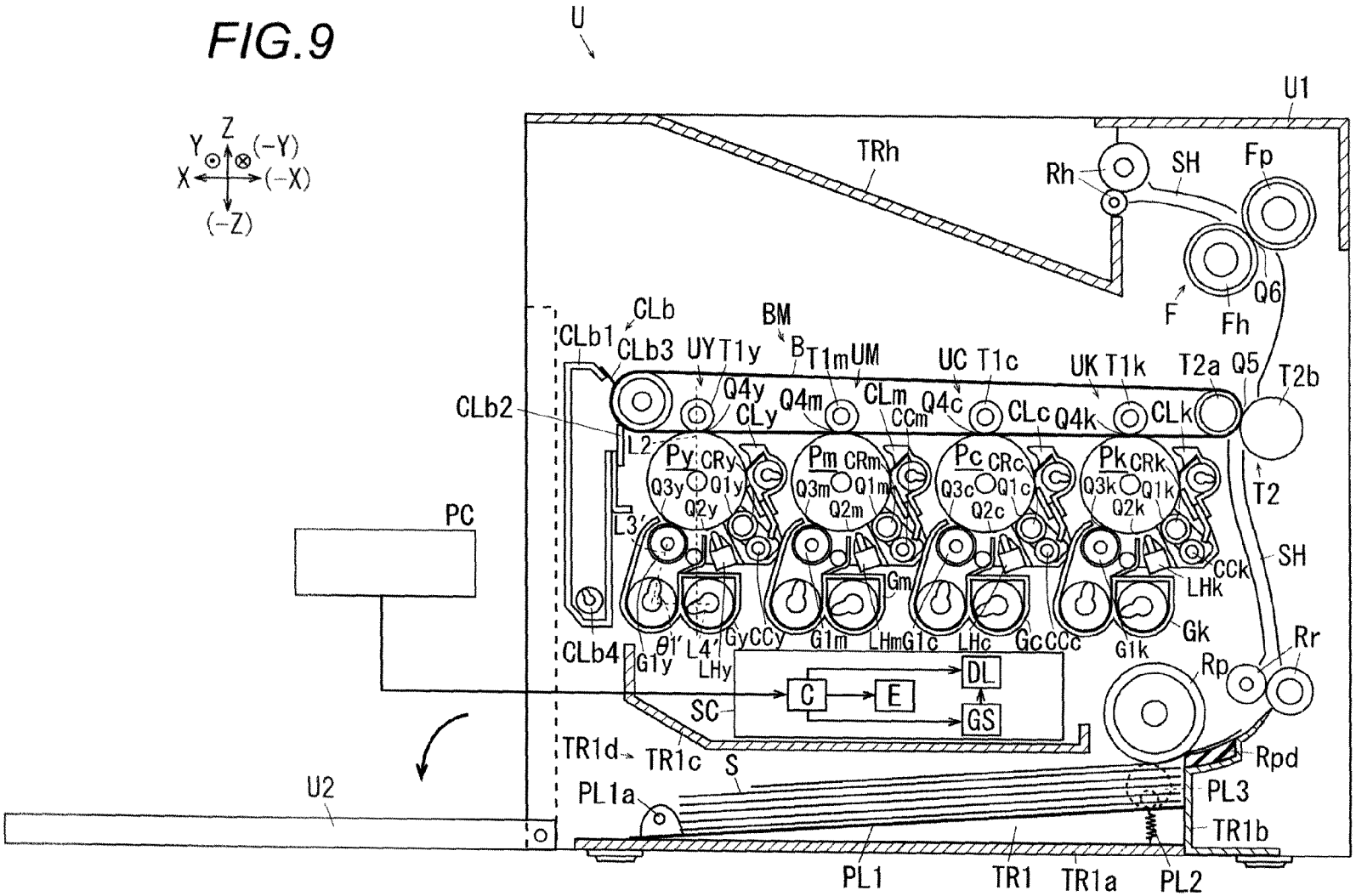
FIG. 9 is an entire explanatory view of an image forming apparatus of Example 2, corresponding to FIG. 3 of Example 1.

FIG. 9 is an entire explanatory view of an image forming apparatus of Example 2, corresponding to FIG. 3 of Example 1 .

Next, Example 2 of the present invention will be described, and in the description of Example 2, a constituent corresponding to a constituent of Example 1 described above is attached with the same reference numeral, and detailed description thereof is omitted.

Example 2 is configured similar to Example 1 except for a difference from Examples 1 as described below.

In FIG. 9, in a printer U of Example 2, different from Example 1, the angle θ1 between the first center-to-center imaginary line L3' connecting the rotation center of the developing roller G1*k* and the rotation center of the supply auger 7 and the second center-to-center imaginary line L4' connecting the rotation center of the supply auger 7 and the rotation center of the admix auger 8 is set to be acute.

Operation Of Example 2

In the printer U of Example 2 having the configuration described above, the admix augers 8 of developing devices Gy to Gk are partially disposed on the opposite sides of the developing rollers G1*k* with respect to the imaginary lines L2, and the angle θ1' between the center-to-center imaginary lines L3' and L4' is set to be acute, and similar to the configuration of Example 1 the visible image forming devices UY to UK and the entire printer U are made smaller than in the conventional configurations.

EXAMPLE 3

Figure 10:
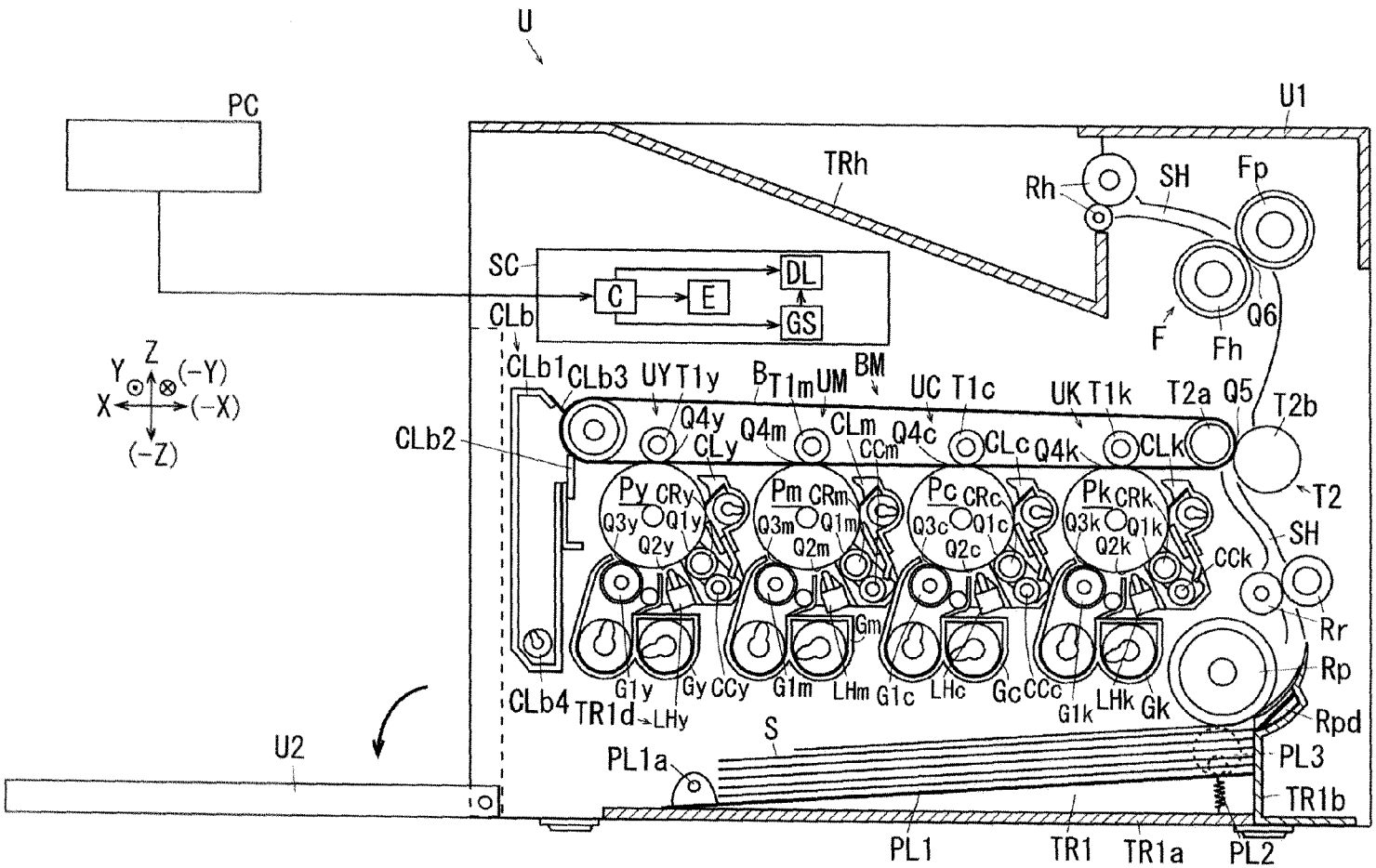
FIG. 10 is an entire explanatory view of an image forming apparatus of Example 3, corresponding to FIG. 3 of Example 1.

FIG. 10 is an entire explanatory view of an image forming apparatus of Example 3, corresponding to FIG. 3 of Example 1.

Next, Example 3 of the present invention will be described, and in the description of Example 3, a constituent corresponding to constituents of Examples 1 and 2 is attached with the same reference numeral and detailed description thereof is omitted.

Example 3 is configured similar to Examples 1 and 2 described above except for differences from Examples 1 and 2 as described below.

In FIG. 10, in the printer U of Example 2, the visible image forming devices UY to UK are configured in the same manner as in Example 2. In the printer U of Example 3, the control board SC is disposed not between the visible image forming devices YK to UK and the paper feeding tray TR1 shown in Examples 1 and 2, but between the intermediate transfer belt B and the sheet discharge tray TRh. Furthermore, in the printer U of Example 3, the position of the paper 10 feeding roller Rp is disposed adjacent to and at the rear of the developing device Gk on the extremely downstream side in the rotation direction of the intermediate transfer belt B.

Operation Of Example 3

In the printer U of Example 3 having the configuration described above, by disposing the control board SC in a space above the intermediate transfer belt B, the height in the up-down direction of the printer U may be reduced, and by disposing the paper feeding roller Rp which is disposed below the visible image forming device UK, adjacent thereto in the horizontal direction, the height of the printer is further reduced.

EXAMPLE 4

Figure 11:
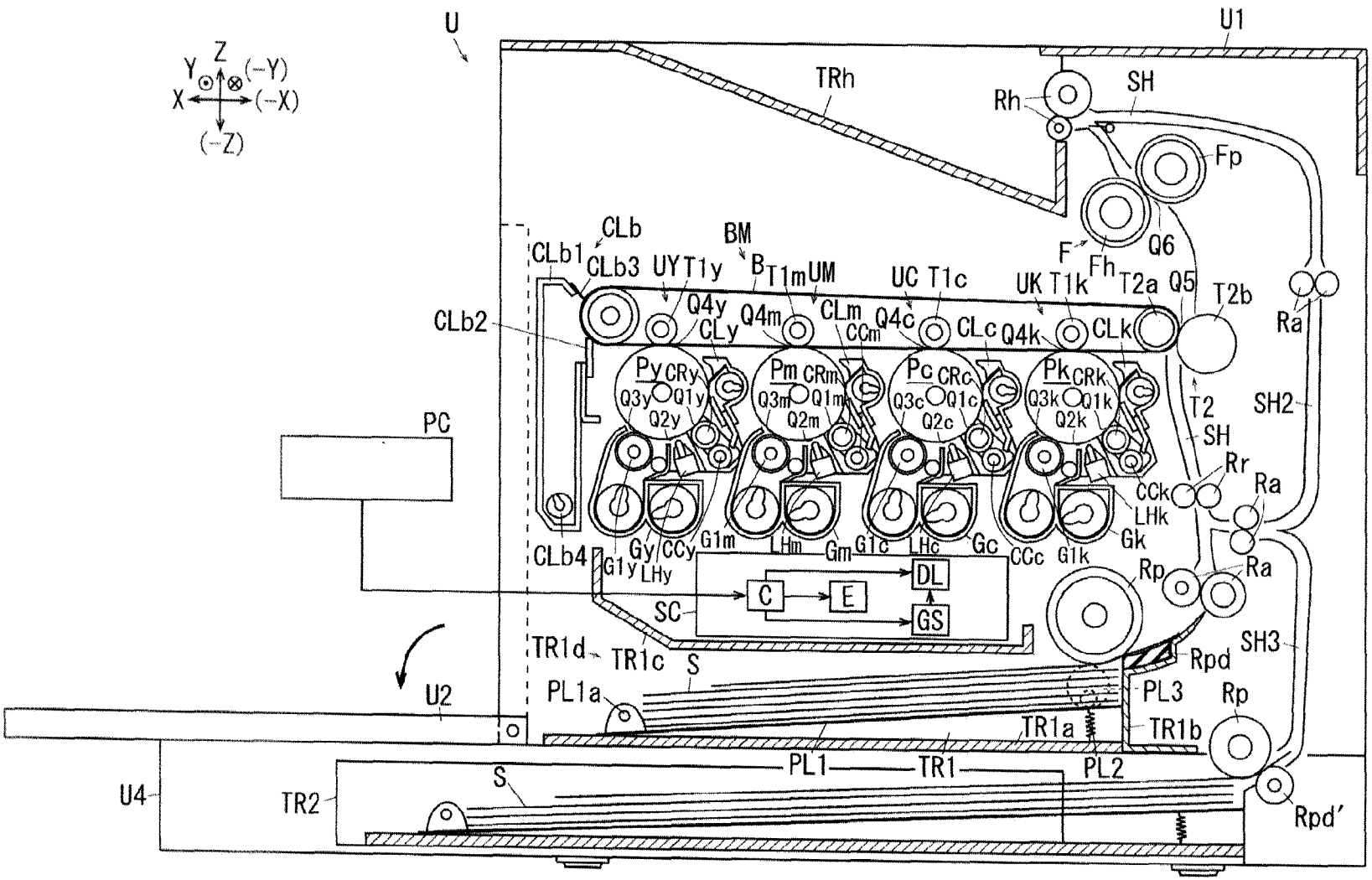
FIG. 11 is an entire explanatory view of an image forming apparatus of Example 4, corresponding to FIG. 3 of Example 1.

FIG. 11 is an entire explanatory view of an image forming apparatus of Example 4, corresponding to FIG. 3 of Example 1.

Next, Example 4 of the present invention will be described, and in the description of Example 4, a constituent corresponding to constituents of Examples 1 and 2 is attached with the same reference numeral and detailed description thereof is omitted.

This Example 4 is configured similar to Examples 1 and 2 except for differences from Examples 1 and 2 as described below.

In FIG. 11, in the printer U of Example 4, the visible image forming devices UY to UK are configured in the same manner as in Example 2 In the printer U of Example 4, a turning-over path S142 as an example of a medium conveyance path which extends from the discharge rollers Rh so as to branch from the medium conveyance path SH and extend rearward, and extends downward at the rear of the fixing device F and the secondary transport roller T2*b*, and joins the medium conveyance path SH on the upstream side of the register rolls Rr is formed. In the case of double-sided printing by the printer U, when the rear end portion in the conveyance direction of the recording sheet S having a first surface on which recording has been performed is conveyed to the discharge rollers Rh, the discharge rollers Rh rotate in reverse and the recording sheet S is delivered to the turning-over path SH2 and conveyed to the register rolls Rr by a plurality of conveyance members Ra in the state where the recording sheet is turned over, and then, images are recorded on the second surface.

In the printer U of Example 4, below the paper feeding tray TR1, an option paper feeding unit U4 as an example of an additional unit is attached. To the option paper feeding unit U4 of Example 4, a paper feeding roller Rp is supported rotatably, and an additional paper feeding tray TR2 as an example of a medium housing in which recording sheets S are stacked is supported in a manner enabling the tray to be inserted and removed in the front-rear direction. The additional paper feeding tray TR2 of Example 4 is configured similar to the paper feeding tray TR1 of Examples 1 to 3. In the option paper feeding unit U4, instead of the retard pad Rpd, a retard roller Rpd' having the same function is disposed. The recording sheets S accommodated in the additional paper feeding tray TR2 are fed by the paper feeding roller Rp, and separated one by one by the retard roller Rpd', conveyed through the additional paper feeding path SH3, and conveyed to the register rollers Rr.

In Example 4, the length in the front-rear direction of the additional paper feeding tray TR2 is formed to be longer than that of the paper feeding tray TR1, and the front end portion projects forward.

Operation Of Example 4

In the printer U of Example 4 having the configuration described above, the visible image forming devices UY to UK are downsized in the same manner as in Example 2 and even in the configuration provided with the turning-over path SH2 and the additional option paper feeding unit U4, the entirety of the printer U is downsized.

EXAMPLE 5

Figure 12:
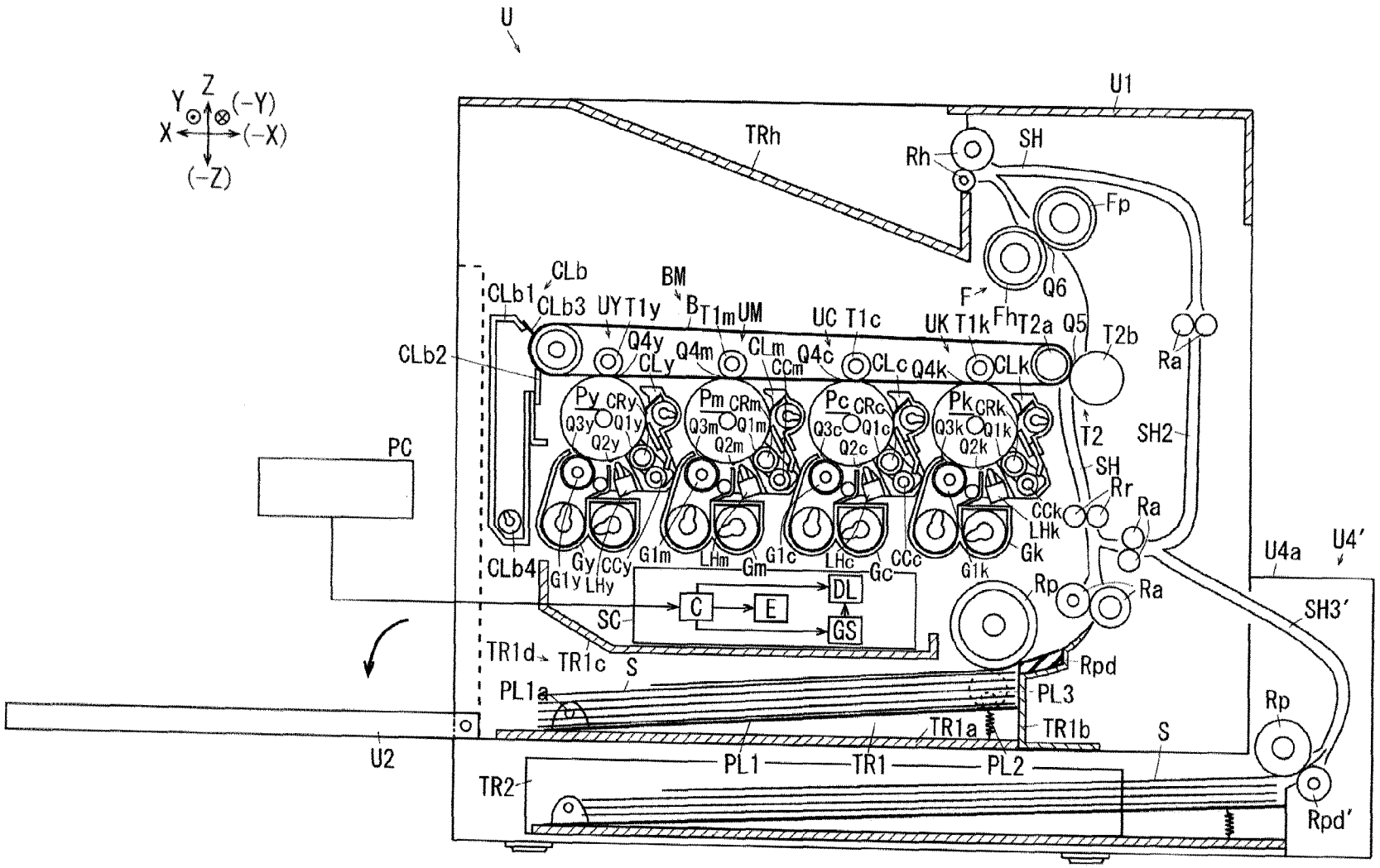
FIG. 12 is an entire explanatory view of an image forming apparatus of Example 5, corresponding to FIG. 3 of Example 1.

FIG. 12 is an entire explanatory view of an image forming apparatus of Example 5, corresponding to FIG. 3 of Example 1.

Next, Example 5 of the present invention will be described, and in the description of Example 5, a constituent corresponding to constituents of Examples 1, 2, and 4 is attached with the same reference numeral and detailed description thereof is omitted.

Example 5 is configured similar to Examples 1, 2 and 4 except for a difference from Examples 1, 2, and 4 as described below.

In FIG. 12, in the printer U of Example 5, an option paper feeding unit U4' as an example of an additional unit includes a paper feeding system housing U4*a* which has a front end face formed flush with the front face of the printer main body U1 and extends along the rear face of the printer main body U1 at the rear end portion. In the paper feeding system housing U4*a*, a paper feeding roller Rp, a retard roller RPd', and an additional paper feeding path SH3' are formed.

Operation Of Example 5

In the printer U of Example 5 having the configuration described above, even in the configuration provided with the turning-over path SH2 and the option paper feeding unit U4 as in Example 4, the entirety of the printer U may be downsized, and the front face may be made flush and the external appearance from the front side may be simplified.

EXAMPLE 6

Figure 13:
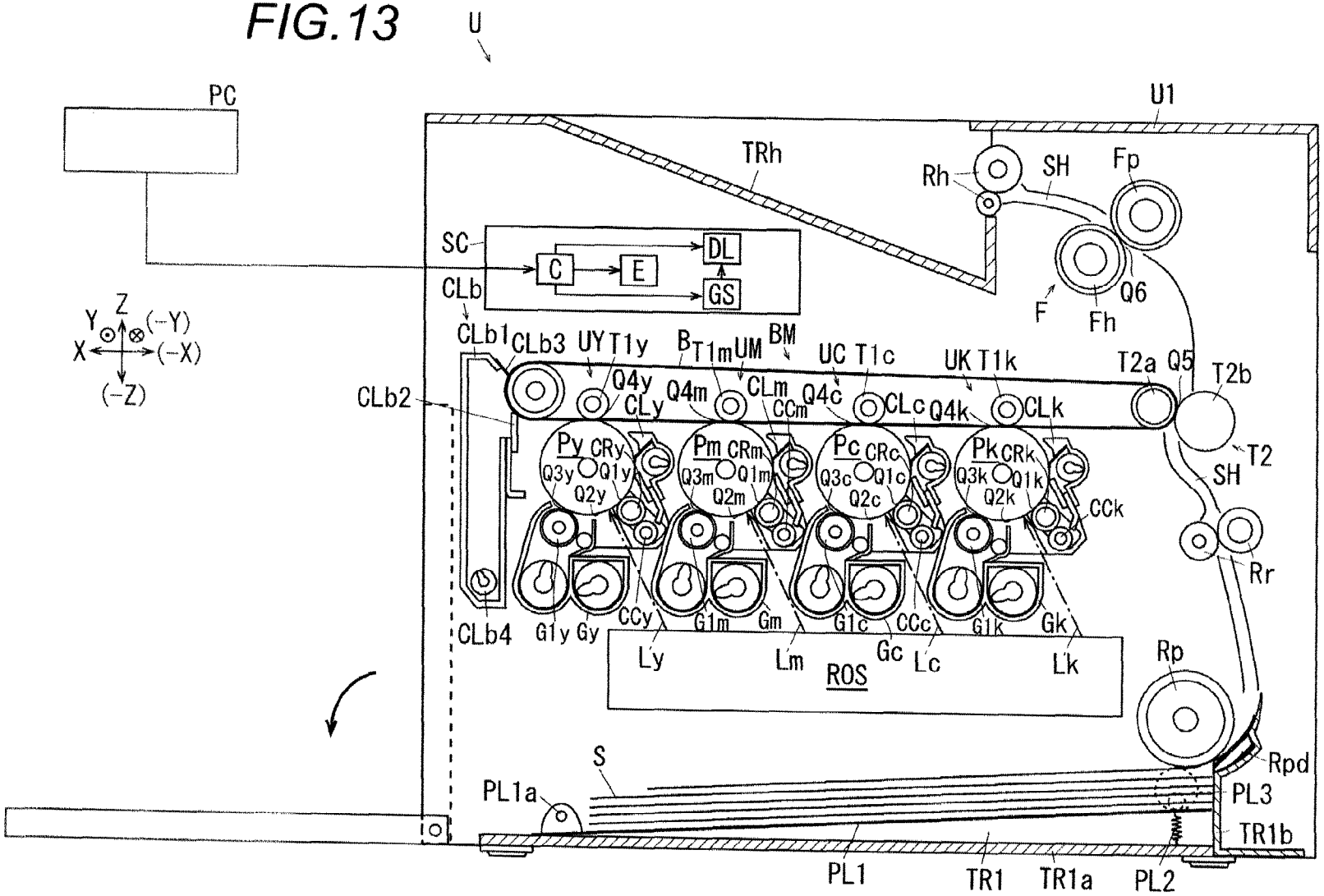
FIG. 13 is an entire explanatory view of an image forming apparatus of Example 6, corresponding to FIG. 3 of Example 1.

FIG. 13 is an entire explanatory view of an image forming apparatus of Example 6, corresponding to FIG. 3 of Example 1.

Next, Example 6 of the present invention will be described, and in the description of Example 6, a constituent corresponding to constituents of Examples 1 to 5 is attached with the same reference numeral and detailed description thereof is omitted. This Example 6 is configured similar to Examples 1 to 5 except for a difference from Examples 1 to 5 as described below.

In FIG. 13, the visible image forming devices UY to UK of Example 6 include, instead of the LED heads LHy to LHk as latent image forming devices used in Examples 1 to 5, a conventionally known latent image forming device, that is, so-called ROS: Raster Output Scanner which forms latent images by scanning the photoconductors Py to Pk in the axial directions with laser beams Ly, Lm, Lc, and Lk as an example of latent image forming light for forming latent images in the respective colors on the surfaces of the photoconductors Py to Pk. In Example 6, the latent image forming device ROS is disposed below the developing devices Gy to Gk, and the control board SC is disposed above the intermediate transfer belt B in the same manner as in Example 3, etc. In Example 6, the laser beams Ly to Lk are irradiated onto the surfaces of the photoconductors Py to Pk through spaces between the charge rollers Cry to CRk and the developer containers 1.

Operation Of Example 6

In the printer U of Example 6 having the configuration described above, while using an ROS-type latent image forming device instead of the LED heads LHy to LHk, the entirety of the printer U may be downsized as in the case of Examples 1 to 5.

EXAMPLE 7

Figure 14:
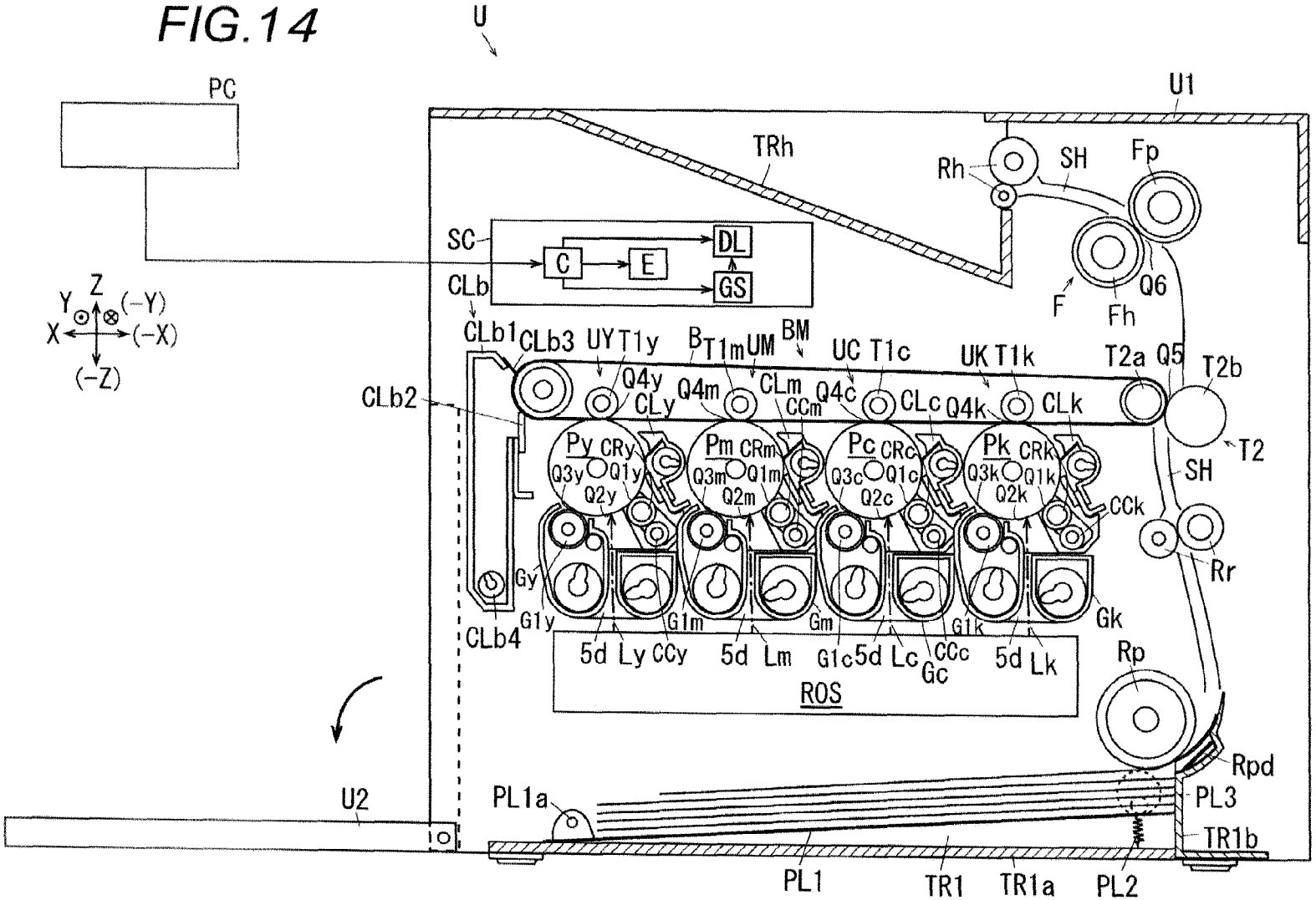
FIG. 14 is an entire explanatory view of an image forming apparatus of Example 7, corresponding to FIG. 3 of Example 1.

FIG. 14 is an entire explanatory view of an image forming apparatus of Example 7, corresponding to FIG. 3 of Example 1.

Next, Example 7 of the present invention will be described, and in the description of Example 7, a constituent corresponding to constituents of Examples 1 to 6 described above is attached with the same reference numeral and detailed description thereof is omitted.

This Example 7 is configured similar to Examples 1 to 6 except for a difference from Examples 1 to 6 as described below.

In FIG. 14, in a printer U of Example 7, an ROS-type latent image forming device is adopted as in the case of Example 6 Laser beams Ly to Lk irradiated from the latent image forming device ROS pass through laser pass-through openings 5*d* as an example of light pass-through openings which are formed in partition walls 5 of the developing devices Gy to Gk and extend in the axial directions of the photoconductors Py to Pk, and are irradiated onto the photoconductors Py to Pk.

Operation Of Example 7

In the printer U of Example 7 having the configuration described above, laser beams Ly to Lk may be made to penetrate through the developing devices Gy to Gk, and in comparison with Example 6, the length in the front-rear direction may be made shorter, and an increase in size of the entire printer U may be reduced.

(Exemplary Variations)

Examples of the present invention are described in detail above, however, the present invention is not limited to the Examples, and may be varied within the scope of the gist of the present invention. Exemplary variations (H01) to (H06) of the present invention are described below.

(H01) In Examples described above, printers as image forming apparatuses are described, however, without limiting thereto, the present invention may also be applied to a facsimile, a copying machine, or a multifunctional printer having all of these functions or a plurality of the functions. Without limiting to the color image forming apparatus, the present invention may also be applied to a monochrome image forming apparatus.

(H02) In Examples described above, a configuration using an intermediate transfer belt as an intermediate transfer member is described, however, without limiting thereto, a configuration using an intermediate transfer drum is also possible. As a transfer device, a transfer device having an intermediate transfer member is described, however, without limiting thereto, it is also allowed that the intermediate transfer member is omitted and toner images are directly transferred onto the recording sheet S as a transferred member from the photoconductors Py to Pk.

(H03) In Examples described above, the charger cleaners CCy to CCk may be omitted.

(H04) In Examples described above, the shape of the belt cleaner CLb may be further downsized. The developer collected by the belt cleaners CLb is collected to collecting containers different from the toner cartridges TCy to TCk, however, it may be collected to any toner cartridge.

(H05) In Examples described above, the toner cartridge TCk corresponding to the visible image forming device UK for black disposed on the extremely downstream side in the rotation direction of the intermediate transfer belt B may be made larger than the toner cartridges TCy to TCc for other colors by using a space on the right of the secondary transfer device T2*b* as shown in FIG. 2 and FIG. 3. Therefore, it is also possible that the toner cartridge TCk for black which is frequently used is increased in size so as to accommodate more new developer.

(H06) In Examples described above, as a paper feeding method, the paper feeding roller Rp, the retard pad Rpd in contact with the paper feeding roller Rp, and the retard roller Rpd' are used, however, without limiting to this configuration, a conventionally known arbitrary configuration may be adopted such as a configuration in which a pickup roller and a jar roller as an example of a feed-out member are disposed to convey the recording sheet S toward the paper feeding roller.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a visible image forming device comprising:

an image carrier that carries and rotates an image on a image carrier surface;

a developing device that develops a latent image on the image carrier surface to form a visible image includes:

a developer container that contains developer therein;

a developer carrier that is disposed opposite to the image carrier surface, and carries the developer on a surface of the developer carrier and rotates oppositely to the image carrier;

a first stirring member that is rotatably supported to be adjacent to the developer carrier inside the developer container and conveys the developer in the developer container to be supplied to the developer carrier while stirring the developer; and a second stirring member that is rotatably supported to be adjacent to the first stirring member inside the developer container and circulates the developer in the developer container by conveying the developer in the developer container oppositely to a conveyance direction of the first stirring member; and a transfer device that is disposed opposite the image carrier surface, and transfers the visible image on the image carrier surface onto a transferred member in a transfer region that is opposite to the image carrier surface, wherein with respect to an imaginary line passing through the transfer region and a rotation center of the image carrier, at least a part of the second stirring member is disposed on an opposite side to a side that the developer carrier is disposed on;

a container attaching and removing part that is provided on an image forming apparatus main body and removably supports a developer accommodation container accommodating a new developer therein;

a replenished developer conveyance path that extends from the container attaching and removing part to each developing device and through which the new developer to be replenished to the developing device is conveyed;

an image carrier cleaner that is disposed opposite to the image carrier and removes and cleans up developer remaining on the image carrier surface after the transfer; and a remaining developer conveyance path that extends from the image carrier cleaner to the container attaching and removing part and extends adjacent to and parallel to the replenished developer conveyance path and through which the developer removed by the image carrier cleaner is conveyed;

wherein the developer accommodation container includes:

a replenished developer accommodation part that accommodates the new developer to be replenished to the developing device;

a replenished developer flow-out port that is formed in the replenished developer accommodation part and connected to an upstream end of the replenished developer conveyance path, and from which the developer in the replenished developer accommodation part flows out a remaining developer collecting part that accommodates developer conveyed via the remaining developer conveyance path therein; and a remaining developer flow-in port that is formed in the remaining developer collecting part, is disposed at substantially the same height as that of the replenished developer flow-out port, and is connected to a downstream end of the remaining developer conveyance path, and thought which the developer in the remaining developer conveyance path flows.

2. The visible image forming device according to claim 1, wherein a second flow-in part that the developer conveyed by the first stirring member flows to the second stirring member is provided out of a carrying region where the image carrier carries the image along an axis direction of the image carrier.

3. The visible image forming device according to claim 2, wherein a replenishment path for replenishing new developer to the developer container is connected to the developer container, and the replenishment path is provided out of the carrying region.

4. The visible image forming device according to claim 3, wherein the replenishment path is provided on a second flow-in part side closer to the second stirring member than the first stirring member flows.

5. The visible image forming device according to claim 1, wherein a part of the developing device is disposed within a projection plane of the image carrier that is formed by applying imaginarily light is irradiated from a transfer region side to the image carrier.

6. The visible image forming device according to claim 1, wherein an angle formed between a first center imaginary line connecting a rotation center of the developer carrier and a rotation center of the first stirring member and a second center imaginary line connecting a rotation center of the first stirring member and a rotation center of the second stirring member is an acute angle.

7. The visible image forming device according to claim 1, further comprising:

a latent image forming device that is disposed opposite to the image carrier surface, forms the latent image on the image carrier surface, and is disposed between the second stirring member and the image carrier.

8. The visible image forming device according to claim 7, wherein the latent image forming device faces the image carrier across the developer container.

9. The visible image forming device according to claim 1, further comprising:

a latent image forming device that is disposed on an opposite side of the image carrier across the developer container and irradiates the image carrier surface with latent image forming light for forming the latent image; and wherein the developer container that has a light pass-through aperture that is formed between the first stirring member and the second stirring member, and allows the latent image forming light to pass through.

10. The visible image forming device according to claim 1, further comprising:

a layer thickness restricting member that is disposed on closer to a side of an imaginary line than the a first center imaginary line connecting a rotation center of the developer carrier and a rotation center of the first stirring member.

11. The image forming apparatus according to claim 1 comprising:

a plurality of the visible image forming devices that have the image carriers arranged horizontally;

the transferred member including an intermediate transfer member that has an intermediate transfer member surface that successively passes through the transfer regions of the visible image forming devices; and a secondary transfer device that secondarily transfers a visible image on the intermediate transfer member surface onto a medium.

12. The image forming apparatus according to claim 1, comprising:

the transferred member including an intermediate transfer member;

a plurality of the visible image forming devices arranged below the intermediate transfer member;

a medium housing that is disposed below the visible image forming devices and houses the media;

a feed member that feeds the media housed in the medium housing one by one toward the secondary transfer device and is disposed below the visible image forming devices and at the most downstream side of the medium housing in the movement direction of the intermediate transfer member surface; and a replenishment port that is formed on the opposite side of the medium housing with respect to a position of the feed member for replenishing the medium to the medium housing, and has an upper wall that slopes upward toward the replenishment port outer side so as to expand the distance to the lower wall of the replenishment port.

13. The image forming apparatus according to claim 1, wherein the replenished developer accommodation part includes:

a first accommodation part that extends upward from the replenished developer flow-out port; and a second accommodation part that is connected to an upper side of the first accommodation part and is disposed at a first position overlapping the replenished developer flow-out port and the remaining developer flow-in port as observed from above the first position; and the remaining developer collecting part includes:

a second collecting part extending downward from the remaining developer flow-in port, and a first collecting part that is connected to a lower side of the second collecting part and is disposed at a second position overlapping the replenished developer flow-out port and the remaining developer flow-in port as observed from below the second position.

14. The visible image forming device according to claim 1, further comprising:

a charger that charges the image carrier surface; and an image carrier cleaner that cleans the image carrier surface.

* * * * *